US006501233B1

(12) United States Patent
Odell et al.

(10) Patent No.: US 6,501,233 B1
(45) Date of Patent: Dec. 31, 2002

(54) SPORTS LIGHTING SYSTEM AND METHOD, ELECTRICAL CONTROL UNIT AND APPARATUS, AND POWER CONNECTOR MODULE

(75) Inventors: William R. Odell, Shawnee, OK (US); Ronald N. Odell, Shawnee, OK (US)

(73) Assignee: Shawnee Lighting Systems, Inc., Shawnee, OK (US)

( * ) Notice: Subject to any disclaimer, the term of this patent is extended or adjusted under 35 U.S.C. 154(b) by 0 days.

(21) Appl. No.: 09/573,005

(22) Filed: May 17, 2000

(51) Int. Cl.[7] ..... G05F 1/00
(52) U.S. Cl. ..... 315/294; 361/673
(58) Field of Search ..... 315/324, 325, 315/312, 318, 319, 320, 321, 291, 307, 294; 307/34, 37, 38; 361/673, 601, 600

(56) References Cited

U.S. PATENT DOCUMENTS

| | | | | |
|---|---|---|---|---|
| 5,366,250 A | * | 11/1994 | Sunabe | 283/81 |
| 5,550,440 A | * | 8/1996 | Allison et al. | 315/294 |
| 5,600,537 A | * | 2/1997 | Gordin et al. | 174/DIG. 2 |
| 6,046,550 A | * | 4/2000 | Ference et al. | 315/291 |
| 6,114,816 A | * | 9/2000 | Nuckolls et al. | 315/324 |
| 6,204,615 B1 | * | 3/2001 | Levy | 315/312 |

* cited by examiner

*Primary Examiner*—Don Wong
*Assistant Examiner*—Ephrem Alemu
(74) *Attorney, Agent, or Firm*—McAfee & Taft

(57) ABSTRACT

A sports lighting system for a large area at which a sporting event occurs includes light structures at the large area to illuminate at least that portion of the large area where the sporting event occurs. A lighting control unit is disposed at the large area. Included are power connector modules connected to a power bus in a cavity of a housing of the unit. Electrical conductors for each of the light structures connect to a respective one of the power connector modules and to lighting on the respective light structure such that electrification of lighting on all the light structures occurs through the lighting control unit. The cavity preferably accommodates expansion or a remote diagnostic unit and mounting on a ground-mounted concrete stanchion. A related method is also disclosed. The present invention also provides an electrical control unit and a power connector module. The power connector module includes: a mounting member to removably connect to a housing; a breaker unit connected to the mounting member and to a power bus in the housing; a contactor unit connected to the mounting member and to the breaker unit; landing lugs connected to the mounting member and to the contactor; and an identification member connected to the mounting member and having indicia identifying the respective electrical equipment from which the respective set of electrical conductors connect to the landing lugs.

18 Claims, 11 Drawing Sheets

SPORTS LIGHTING SYSTEM AND METHOD, ELECTRICAL CONTROL UNIT AND APPARATUS, AND POWER CONNECTOR MODULE

BACKGROUND OF THE INVENTION

This invention relates generally to electrical control for electrical equipment used over a large area and more particularly, but not by way of limitation, to sports lighting systems and components thereof, such as used at arenas and stadiums.

Many sporting events are conducted at large area sports facilities such as arenas and stadiums. Non-limiting examples include basketball and hockey arenas; football, baseball and soccer stadiums; and racetracks. These locations typically have lighting equipment distributed around the large area for illuminating at least the portion of the area where the playing of the event occurs (and frequently also to illuminate the spectator portions of the area as well).

To centralize control of such electrical equipment, electric conductors may be run from each of the lighting structures to a single location where all the lights are to be controlled (at least with regard to turning the lights on and off by switching respective light circuits into and out of connection with a power main). The type of installation at such common location has heretofore typically been left to whomever installs the equipment. This leads to non-standardization and no uniformity, to say the least. Other shortcomings may include lack of consistent organization and color coding of the wiring at the control location, lack of facilitating repairs (e.g., replacing a malfunctioning circuit breaker), lack of quality control, and sometimes even a lack of safety (including possible code violations). In view of these shortcomings, there is the need for an improved technique for coordinating the control of lighting at a large area facility, particularly a sports event facility. More broadly, there is the need for an electrical control unit and a power connector module which can be used in a large area facility or in other environments in which centralized electrification control is needed (non-limiting examples include parking lots, fairgrounds and other festival or community gathering places).

SUMMARY OF THE INVENTION

The present invention overcomes the above-noted and other shortcomings of the prior art, and satisfies the aforementioned needs, by providing a novel and improved sports lighting system and method, electrical control unit and apparatus, and power connector module. The present invention facilitates: consistent organization and color coding of wiring, installation and repairing, quality control, code compliance, and safety at an electrical control location.

The present invention provides a sports lighting system for a large area at which a sporting event occurs. This system comprises a plurality of light structures located at the large area to illuminate at least that portion of the large area where the sporting event occurs, and it also comprises a lighting control unit disposed at the large area. The lighting control unit includes: a housing providing a protected cavity; a main circuit breaker disposed in the cavity of the housing and connected to a three-phase power main; a three-phase power bus disposed in the cavity of the housing and connected to the main circuit breaker; and a plurality of power connector modules connected to the three-phase power bus in the cavity of the housing. The sports lighting system further comprises respective sets of electrical conductors for each of the plurality of light structures, wherein each respective set connects to a respective one of the power connector modules of the lighting control unit and to lighting on the respective light structure such that electrification of lighting on all the light structures occurs through the lighting control unit. In a preferred embodiment, the cavity of the housing includes a region providing means for receiving a remote diagnostic unit for monitoring operation of the plurality of light structures. The system may further comprise a ground-mounted concrete stanchion at the large area; and the lighting control unit further may include a plurality of brackets connected to the housing and mounted on the concrete stanchion.

The present invention also provides a method for illuminating at least a sports event portion of a large area sports facility. This method comprises activating and deactivating a plurality of light structures, which structures are disposed throughout the sports facility to provide light for at least the sports event portion of the sports facility, from a unitary enclosed lighting control unit located at the sports facility and having a plurality of power connector modules removably disposed therein. This includes conducting electric current through a respective one of the power connector modules to activate a respective one of the light structures and identifying the respective light structure with indicia on the respective power connector module. This method may further comprise sensing current flow through each of the power connector modules from within the unitary enclosed lighting control unit and transmitting out of the unitary enclosed lighting control unit data about the sensed current flow.

The present invention also provides apparatus for controlling lighting for a large area at which a sporting event occurs. The apparatus comprises: a ground-mounted concrete stanchion installed at the large area; and a lighting control unit connected to the concrete stanchion, the lighting control unit including a housing providing a protected cavity in which main electrical power control connections are made to a plurality of light structures located at the large area to illuminate at least that portion of the large area where the sporting event occurs. In a preferred embodiment the lighting control unit further includes: a main circuit breaker disposed in the cavity of the housing to connect to a three-phase power main; a three-phase power bus disposed in the cavity of the housing and connected to the main circuit breaker; and a plurality of power connector modules connected to the three-phase power bus in the cavity of the housing.

An electrical control unit of the present invention comprises: a housing providing a protected cavity; a main circuit breaker disposed in the cavity of the housing to connect to a three-phase power main; a three-phase power bus disposed in the cavity of the housing and connected to the main circuit breaker; and a plurality of power connector modules connected to the three-phase power bus in the cavity of the housing. Such electrical control unit may further comprise a plurality of brackets connected to the housing to mount on a ground-mounted concrete stanchion.

A power connector module of the present invention comprises: a mounting member to removably connect to a housing; a breaker unit connected to the mounting member and to a three-phase power bus in the housing; a contactor unit connected to the mounting member and to the breaker unit; landing lugs connected to the mounting member and to the contactor for connecting to a respective set of electrical conductors connected to electrical equipment to be electrified through the power connector module; and an identification member connected to the mounting member and having indicia identifying the respective electrical equipment from which the respective set of electrical conductors connect to the landing lugs.

Therefore, from the foregoing, it is a general object of the present invention to provide a novel and improved sports lighting system and method, electrical control unit and apparatus, and power connector module. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 8 is a front inside view of one implementation of an electrical control unit of the embodiment of FIGS. 5–7.

FIG. 9 is schematic side view, partially sectioned, showing a back plate assembly seen from the front in FIG. 8.

FIG. 12 is a front view of a preferred embodiment of a control transformer module shown in FIGS. 8–10.

FIG. 13 is a front inside view of another implementation of the electrical control unit.

DETAILED DESCRIPTION OF THE INVENTION

Figure 1:
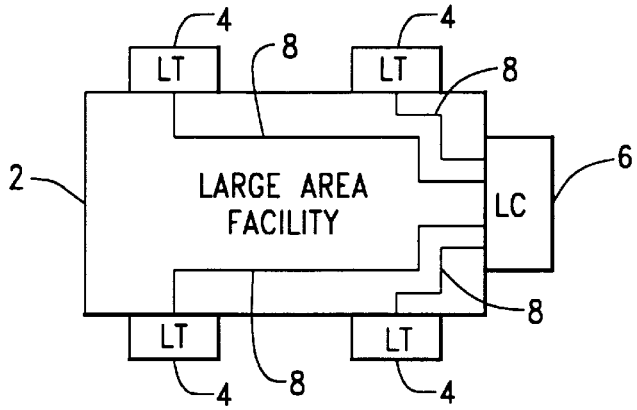
FIG. 1 is a block representation of a large area facility having distributed lighting structures wired to a lighting control unit in accordance with the present invention.

A large area facility 2 is represented in FIG. 1. In a particular implementation, the large area facility 2 is a sports facility at which a sporting event occurs. Non-limiting examples include basketball and hockey arenas; football, baseball and soccer stadiums; and racetracks.

Installed at the facility 2 are a plurality of light structures 4. Four such structures are depicted in FIG. 1, with the group of them located at the large area to illuminate at least that portion of the large area where the sporting event occurs. Typically the lighting also illuminates at least part of the spectator portions of the facility as well. One type of light structure is a light tower having a concrete or metallic pole and light fixtures attached to the pole. Particular examples include light structures provided by Musco Lighting, Inc. of Oskaloosa, Iowa.

To provide a common control location, the sports lighting system depicted in FIG. 1 further comprises a lighting control unit 6 disposed at the large area. Respective sets 8 of electrical conductors for the plurality of light structures 4 connect the lighting control unit 6 to the respective lighting structures 4 such that electrification of lighting on all the light structures occurs through the lighting control unit. In a particular implementation, each set 8 of conductors typically includes two or three wires to connect with an alternating current power source coupled through the lighting control unit 6.

Figure 2:
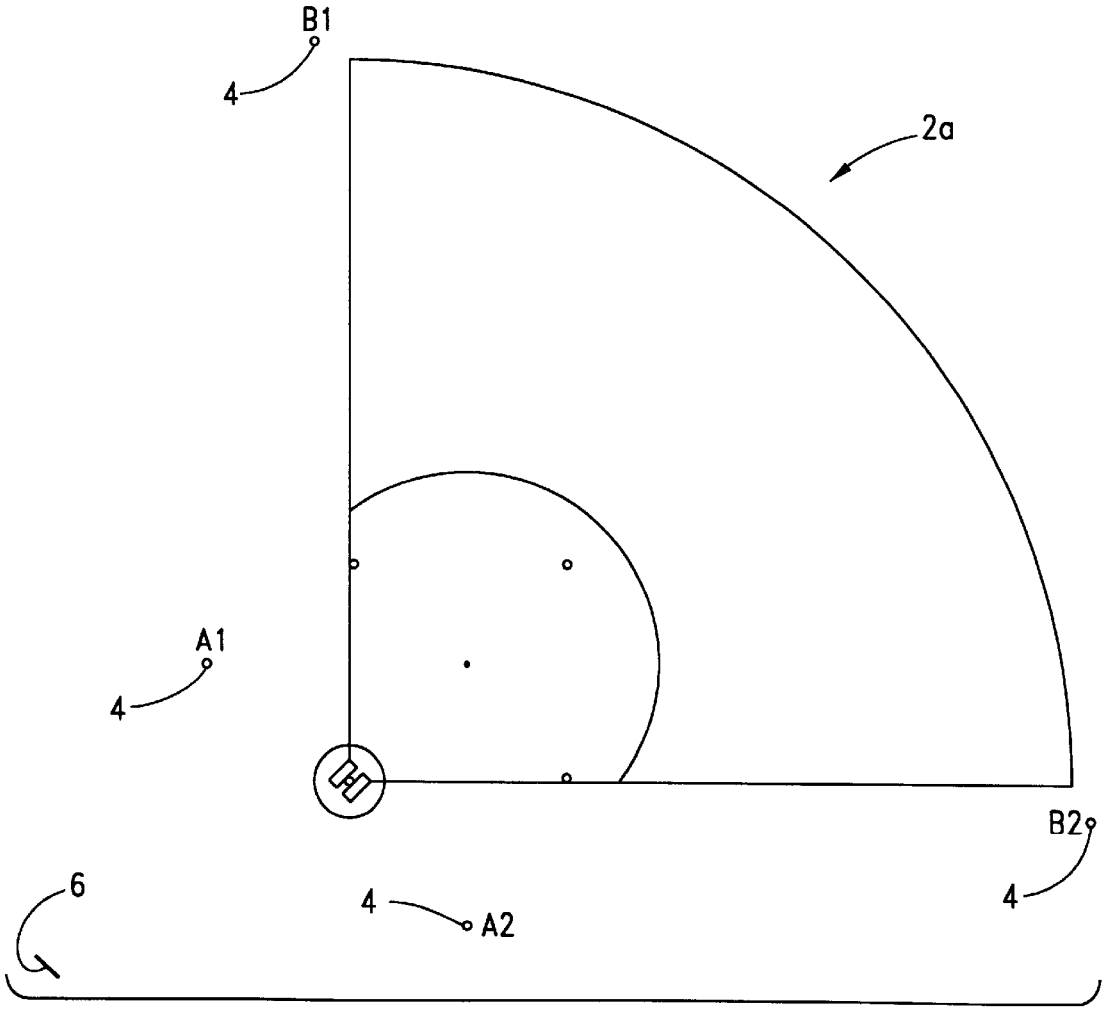
FIG. 2 depicts a softball field or stadium having four lighting structures wired to a lighting control unit as one example of what is more generally represented in FIG. 1.
Figure 3:
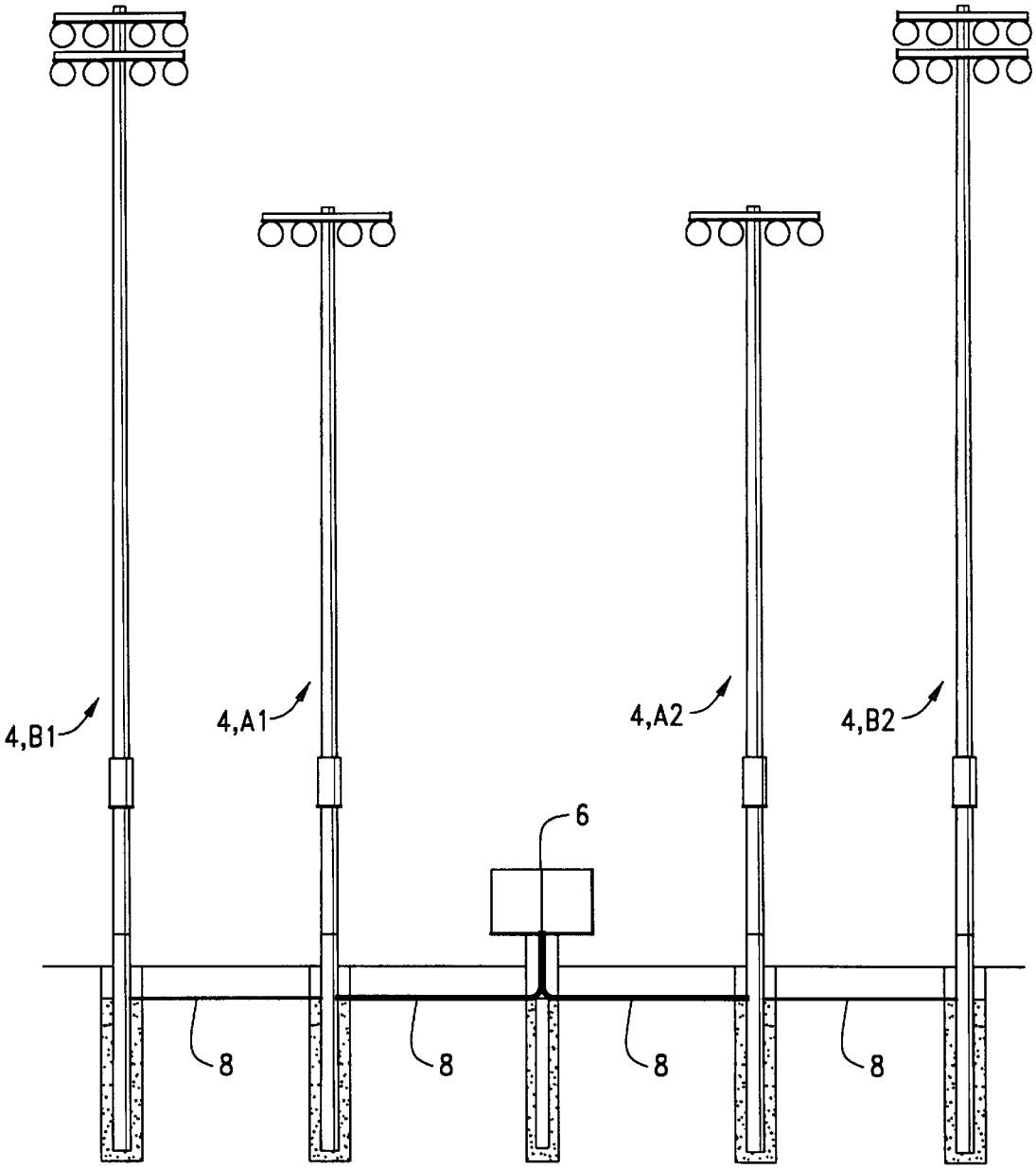
FIG. 3 is a pictorial and schematic illustration of four particular lighting structures wired to the lighting control unit represented in FIG. 2.

A non-limiting example of a sports lighting system of the present invention is illustrated in FIG. 2, which depicts a softball field or stadium 2*a* as the large area facility. F our light structures 4, specifically labeled as A1, A2, B1, B2, are shown in illustrative locations, as is lighting control unit 6. Implementations of these are pictorially illustrated in FIG. 3. These illustrate, for example, sixty-feet tall poles A1, A2 each having four light fixtures, and seventy-feet tall poles B1, B2 each having eight light fixtures. These are illustrated as connected by the cables 8 to the lighting control unit 6 which provides access to power source cable and metering (e.g., from a public utility) and an enclosure and circuitry, including a master on/off switch, for operating each of the lighting structures. A schematic diagram of one implementation of such circuitry is shown in FIG. 4.

Figure 4:
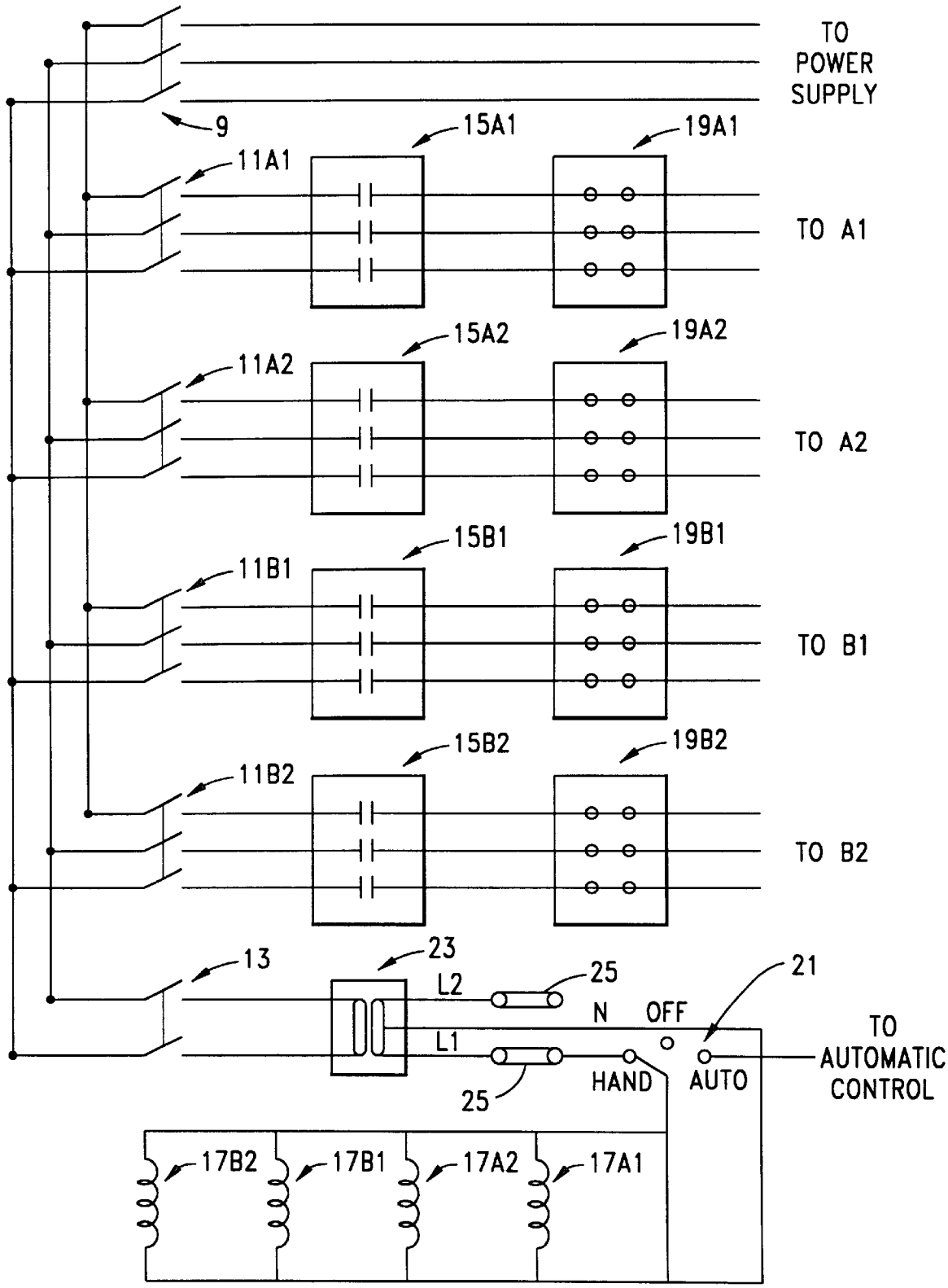
FIG. 4 is a schematic wiring diagram for the lighting control unit of the illustration of FIG. 3.
Figure 3:
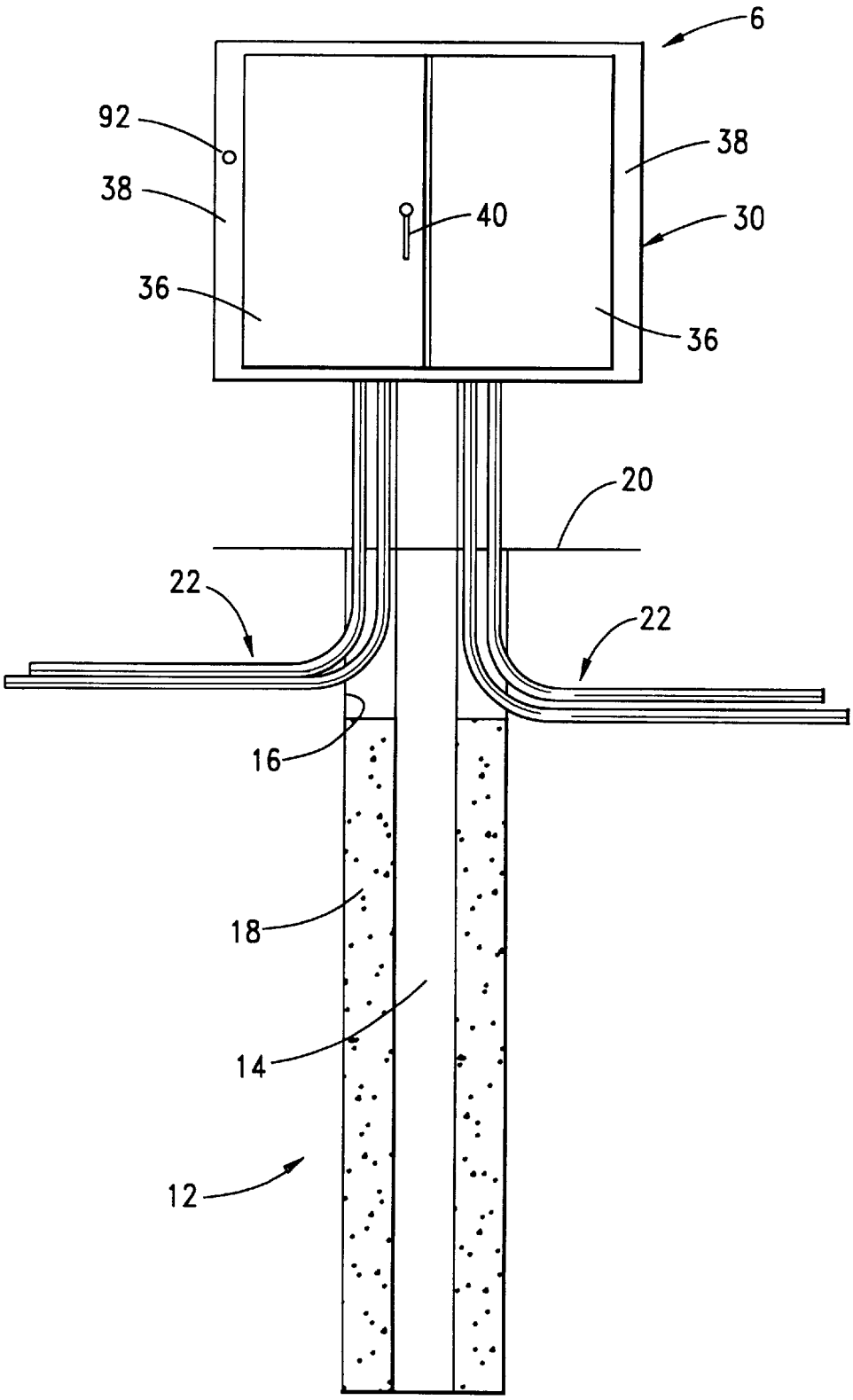

In FIG. 4, a main circuit breaker 9 connects the remainder of the circuit to the power supply. There is a circuit breaker 11A1, 11A2, 11B1, 11B2 for the light structures A1, A2, B1, B2, respectively; and there is also a circuit breaker 13 for an on/off control circuit. In a particular implementation such as for the illustration of FIG. 3, the circuit breaker 9 is a commercially available 200-amp, 3-phase circuit breaker; each of the circuit breakers 11A1, 11A2 is a commercially available 30-amp, 3-phase circuit breaker; each of the circuit breakers 11B1, 11B2 is a commercially available 60-amp, 3-phase circuit breaker; a nd the circuit breaker 13 is a commercially available 20-amp, 2-phase circuit breaker.

In series with the circuit breakers 11A1, 11A2, 11B1, 11B2 are commercially available 3-phase switching devices having relay contactors 15A1, 15A2, 15B1, 15B2, respectively, and relay windings 17A1, 17A2, 17B1, 17B2, respectively. In series with the contactors 15A1, 15A2, 15B1, 15B2 are connectors 19A1, 19A2, 19B1, 19B2, respectively, which facilitate connecting to the conductors 8 extending to the respective light structures A1, A2, B1, B2.

To operate the light fixtures of the structures A1, A2, B1, B2, a single-pole, three-position switch 21 is shown in FIG. 4. In the manual ("hand") position of the switch as illustrated in FIG. 4, one line (L1) from the secondary of a commercially available step-down transformer 23 is connected through fuse 25 to one side of the relay windings 17A1, 17A2, 17B1, 17B2; the other side of each of these windings is connected to a neutral line from the transformer 23. In another position of the switch 21 ("auto"), an automatic controller (e.g., local or remote timer control) can be connected to the relay windings.

Figure 5:
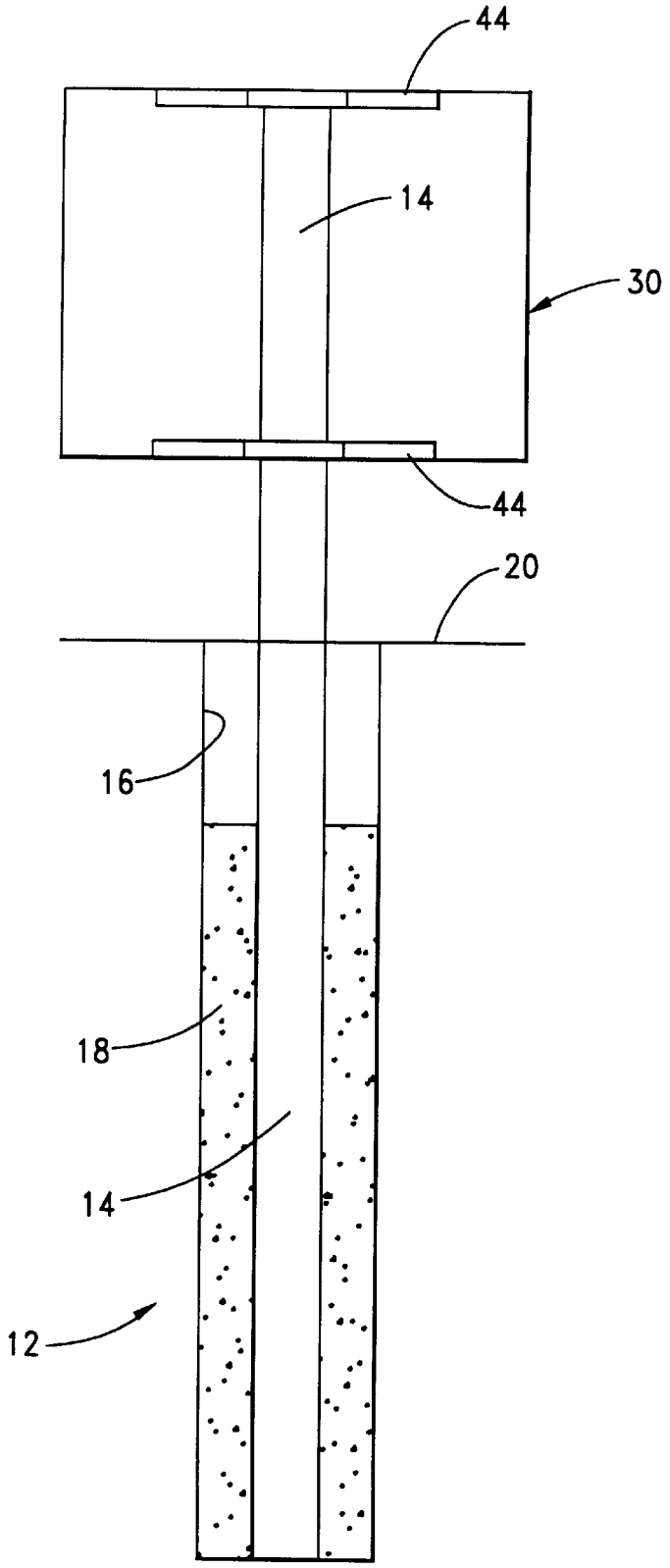
FIG. 5 is a front view of a preferred embodiment of an apparatus for controlling lighting for a large area such as represented in FIGS. 1 and 2.
Figure 7:
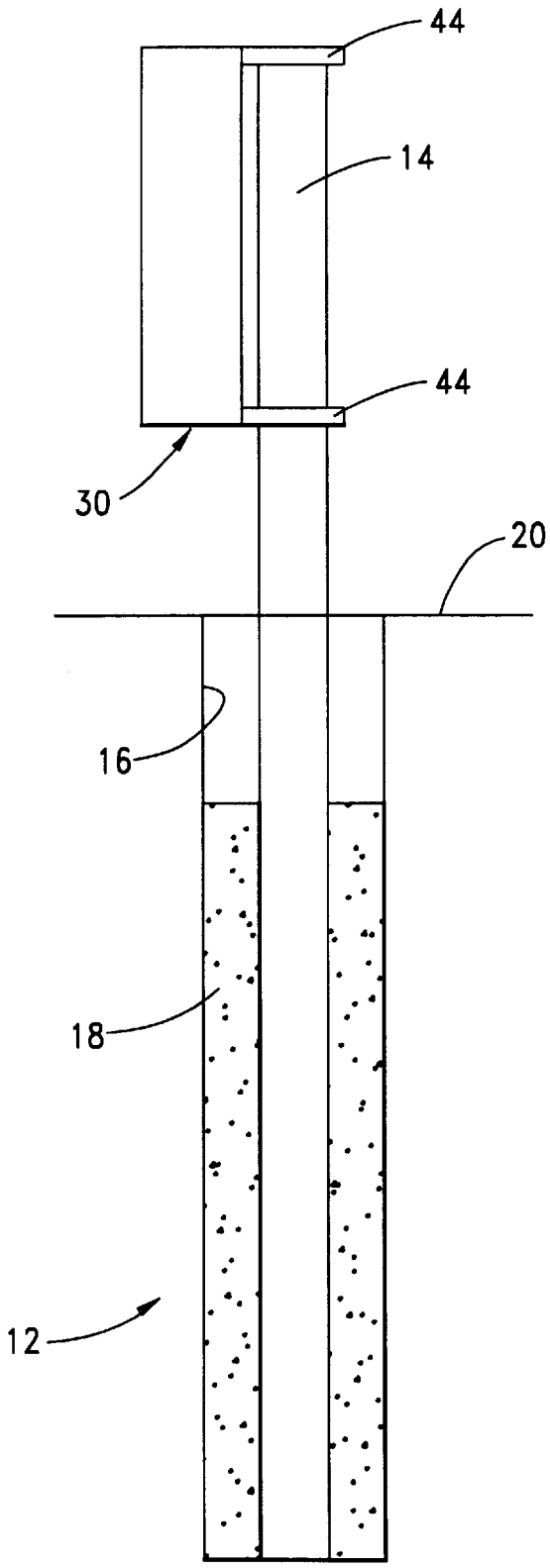
FIG. 7 is a side view of the apparatus of FIGS. 5 and 6.
Figure 3:
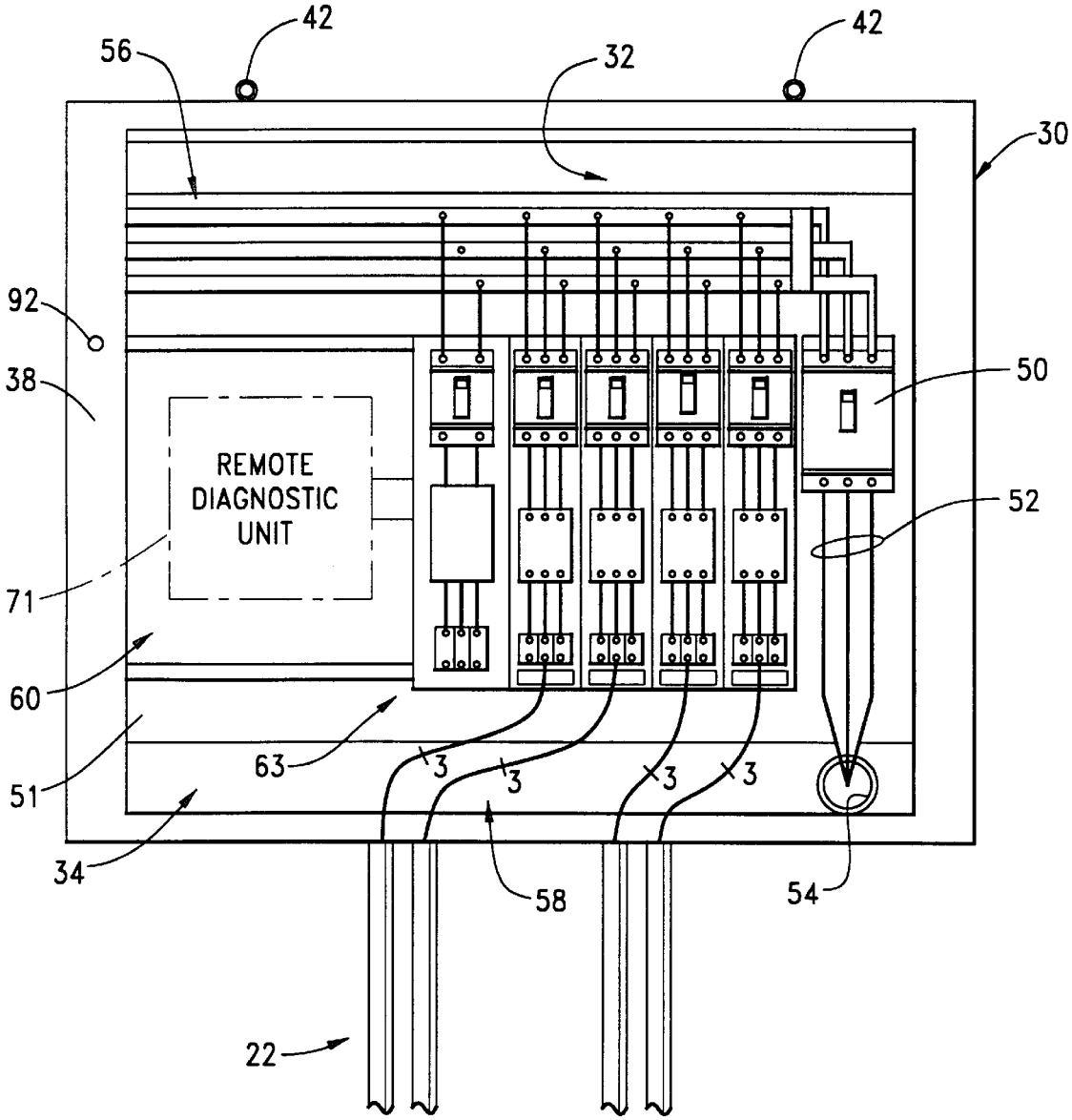
Figures 5, 6:
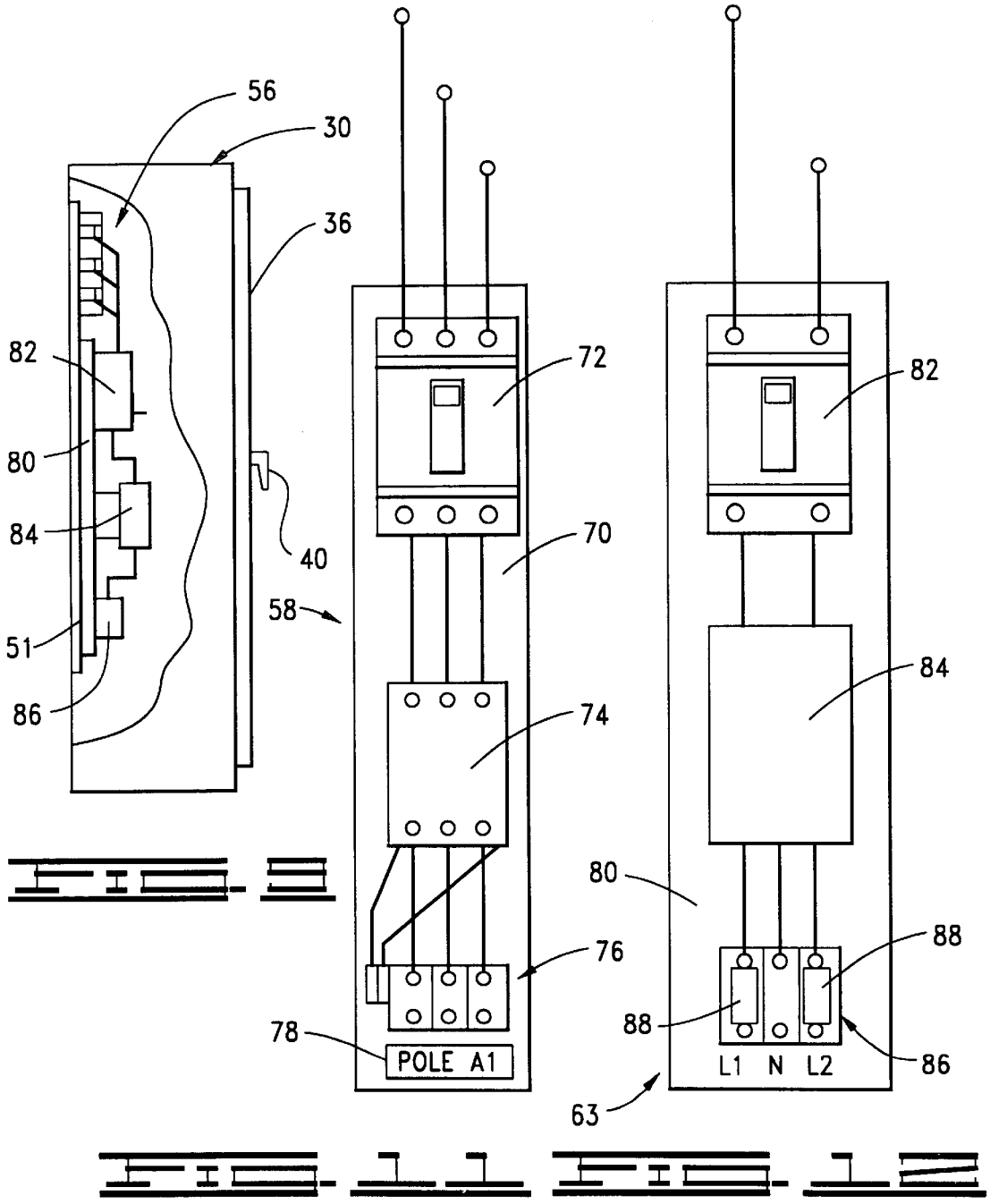
FIG. 6 is a rear view of the apparatus of FIG. 5.

Referring to FIGS. 5–7, at any suitable large area facility for the present invention, the lighting control unit 6 along with a ground-mounted concrete stanchion 12 at the large area form a particular implementation of an apparatus for controlling lighting for the large area at which the sporting event occurs. Although broader aspects of the present invention are not limited to a particular mounting structure or arrangement, it is a particular aspect of one implementation of the invention to include the ground-mounted concrete stanchion 12. Such a stanchion may be of any suitable type known in the art, but one particular example shown in these drawings includes a concrete mounting base 14 set in a twenty-four inch diameter pier hole 16 which is ten feet deep and back filled with 3,000 pound concrete 18 to within about two feet of the ground surface 20. The space above the concrete 18 permits underground conduits 22 which carry the conductors 8 to emerge from directly beneath a housing of the lighting control unit 6. Although not illustrated, an outer jacket or covering made of suitable material can be used to provide an enclosure around the above-grade portion of the conduits 22.

Although the lighting control unit 6 is part of the system and apparatus described above, it can be used more generally as an electrical control unit in any suitable application, including those referred to above as well as others in which dispersed electrical equipment needs centralized control of electricity application. Preferred embodiments of such control unit 6, whether adapted specifically as a lighting control unit or more generally as an electrical control unit, will be described next with reference to FIGS. 5–14.

Referring initially to FIGS. 5–8, the electrical control unit 6 includes a housing 30. The housing 30 provides a protected cavity 32 (FIG. 8) in which main electrical power control connections are made to the plurality of light structures (or other electrical equipment to which power control is to be provided through the unit 6) located at the large area. The housing 30 may be made of any suitable material; however, aluminum or stainless steel are two preferred materials because they resist rust and ultraviolet deterioration, thereby providing good durability (in one particular implementation, the body of the housing is aluminum and the hinges and latches are stainless steel). These materials also provide good heat dissipation. Metal parts preferably are covered with a commercially available powder coating (e.g., an electrostatically applied paint).

The housing 30 illustrated in the drawings is a six-sided box, with the front side providing an opening 34 into the cavity 32. The opening 34 may be opened or closed by two doors 36 (FIG. 5; removed in the view of FIG. 8) connected by hinges to mounting flanges 38 of the main body of the housing box structure. The doors 36 may be secured in their closed positions by a key locking handle 40 with three-point latch in a specific implementation. Each of the sides of the housing of this implementation is rectangular as apparent from the drawings to define a rectilinear structure; however, other shapes may be used. The housing can be of any suitable size, but a preferred range of sizes for implementation in the sports lighting system and apparatus of the invention includes from 48 inches by 60 inches by 12 inches to 48 inches by 78 inches by 12 inches. Suitable reinforcing structure can be used as needed (e.g., in a particular implementation within the aforementioned size range, L-shaped angle members two inches by two inches by one-quarter-inch are connected along the top and bottom lengths of the back wall).

Lifting eyes 42 are connected to the top side of the housing 30 as shown only in FIG. 8. A plurality of removable brackets 44 (FIGS. 6 and 7) are connected to the back wall of the housing 30 to mount on the ground-mounted concrete stanchion 12 in the implementation depicted in FIGS. 5–7. In the particular implementation, each bracket is made of a suitable material (e.g., powder coated steel covered with an aluminum shell) and each has a trapezoidal shape with a central hole drilled (or otherwise formed) to receive the base 14 of the stanchion 12. In each bracket 44 of the particular implementation, four holes are drilled transverse to the axis of the central hole along the longest edge of the trapezoidal shape. A respective nut is welded or otherwise suitably fastened to the bracket in concentric relation to a respective one of the transverse holes. A respective bolt (e.g., ½-inch diameter) for each nut is inserted through a respective hole defined in the back wall (e.g., ¼-inch thick aluminum) of the housing 30 (e.g., for a total of four ⅝-inch holes along top of the back wall and four ⅝-inch holes along bottom of the back wall) and screwed into a respective one of the nuts and transverse holes to releasably connect the respective bracket 44 to the housing 30. The brackets are held on the stanchion 12 by suitable means (e.g., one or more set screws fastened through other transverse holes defined in the respective bracket 44, other compression means, or by tapering the stanchion to have a portion wider than the diameter of the central hole of a respective one of the brackets 44). A cover (not shown) can be placed over the brackets and the stanchion 12 along the outer back of the housing 30.

Referring more particularly to FIG. 8, a particular structure to implement the circuit of FIG. 4 within the housing 30 will be described. In FIG. 8, the control unit 6 further includes a main circuit breaker 50 disposed in the cavity 32 of the housing 30. The main breaker 50 corresponds to the breaker 9 of FIG. 4. The breaker 50 is attached in suitable manner (e.g., by screws) to an individual mounting member which is in turn connected to a larger main mounting plate 51 attached to the back wall of the housing 30 in a suitable manner (e.g., screwed to stainless steel mounting studs extending from the back wall of the housing 30).

One electrical side of the circuit breaker 50 connects to a three-phase power main through suitable conventional electrical conductors 52 (e.g., commercial copper alloy wires) fed through an aperture 54 defined in the back wall of the housing 30. The other electrical side of the circuit breaker 50 connects to a three-phase power bus 56 disposed in the cavity 32 of the housing 30 via insulated mounting on the mounting plate 51. In a particular implementation, the bus 56 includes three copper bus bars rated at 660 volts(ac) and connected to the mounting plate 51 on insulating blocks and preferably having an insulating protective cover (not shown).

Also mounted on the mounting plate 51 in the cavity 32 of the housing 30, and electrically connected to the power bus 56, are a plurality of power connector modules 58, each of which includes components to embody a respective series of the breakers 11, switching devices 15/17, and connectors 19 shown in FIG. 4. Four such modules 58 are shown in the embodiment of FIG. 8, such as can be used with the installment illustrated in FIGS. 2 and 3. Each of the modules 58 is mounted in the cavity 32 so that it can readily be removed and replaced. This is accomplished in the more detailed illustrated embodiment of FIG. 10 by using a trough member 57 (e.g., a metal bar or strip formed to define a channel or trough) suitably connected (e.g., bolted or screwed) to the mounting plate 51, by inserting the lower edge of the respective module 58 into the trough, pushing the top of the module toward the mounting plate 51, and suitably connecting the top to the plate 51 (e.g., by one or more bolts or screws).

Figure 10:
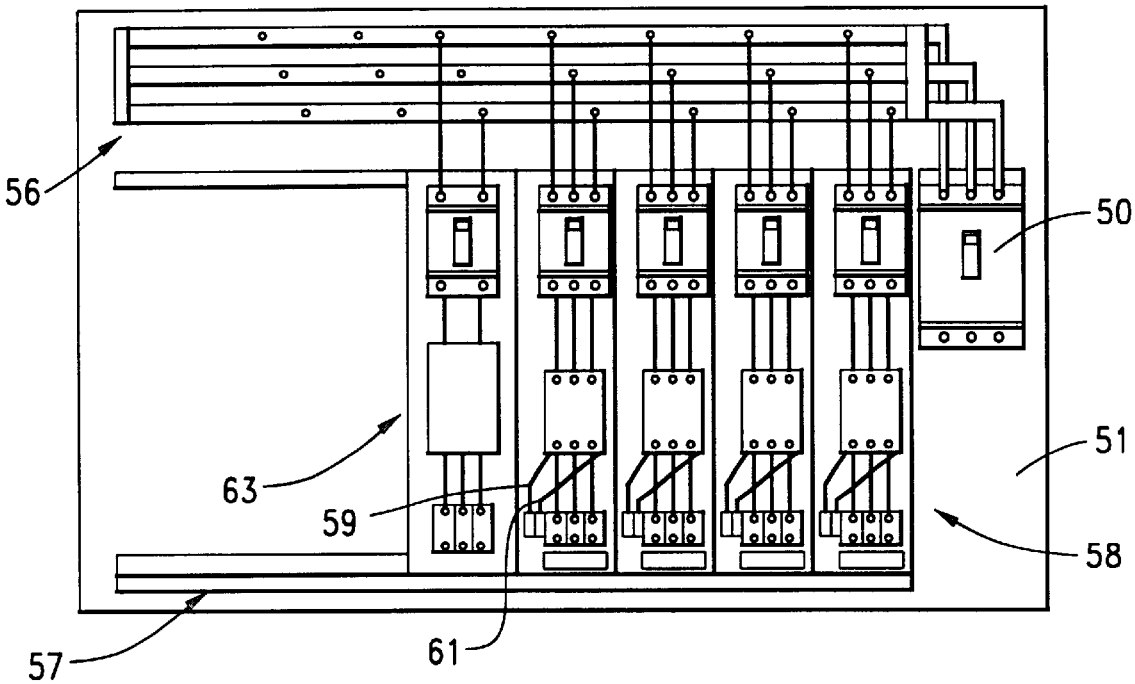
FIG. 10 is a more detailed front view of the back plate assembly.

Also shown in FIG. 10 on each of the modules 58 are two wires 59, 61 (only one set lableled in the drawing). These wires correspond to the L1 and N conductors shown in FIG. 4, and they connect to a control transformer module 63 of the illustrated preferred embodiment whereby the contactor relay coils (elements 17 in FIG. 4) are connected in parallel to the secondary of the transformer of the module 63. The control transformer module 63 implements the breaker 13, transformer 23 and fuses 25 of the circuit of FIG. 4.

Figure 11:
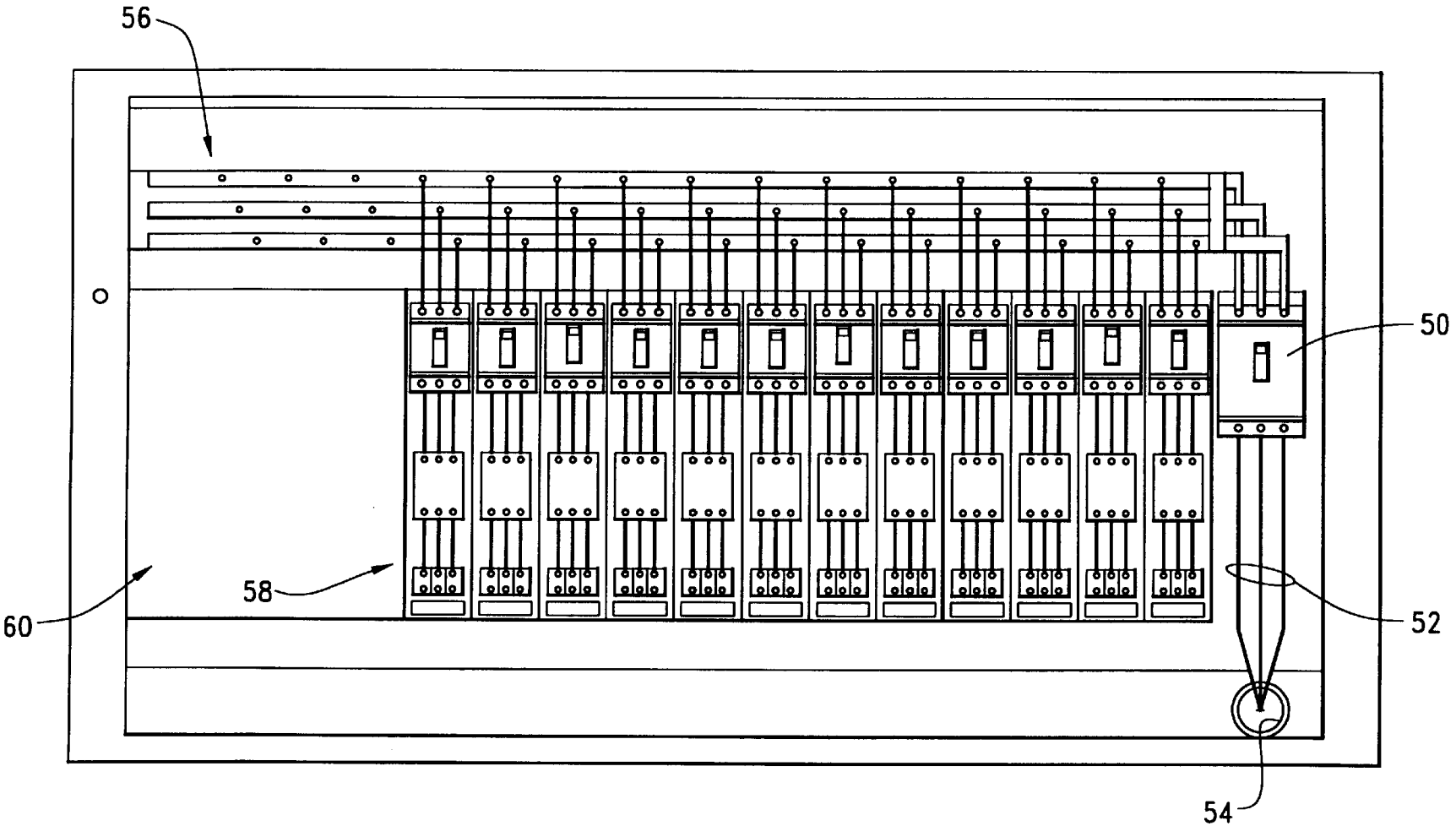
FIG. 11 is a front view of a preferred embodiment of a power connector module of the present invention, which module is one of several used in the embodiments of the electrical control unit of FIGS. 8–10.

The structure of one of the power modules 58 will be further described with reference to FIG. 11, followed by a further description of the control transformer module 63 with reference to FIG. 12. Referring first to FIG. 11, it shows a particular implementation of one of the power connector modules 58. The illustrated module 58 includes a mounting member 70. In a particular implementation the member 70 is made of 16 gauge powder coated metal arid is 5-inches wide by 24-inches high in its installed orientation shown in FIGS. 8–10. The lower edge of this member 70 fits in the trough member 57 as illustrated in FIG. 10. A similar mounting member is used for the main breaker 50; however, it is eight inches wide in the particular implementation referred to herein and it need not be as long as the one for the module 58, as apparent from the representation in FIGS. 8 and 10.

Referring to FIG. 11, a breaker unit 72 is connected to the mounting member 70. One electrical side of the breaker unit 72 is adapted to connect to the three-phase bus 56 (such as by the illustrated wires), and the other electrical side connects to a contactor unit 74 which is mechanically connected to the mounting member 70. The breaker unit 72 and the contactor unit 74 may be commercially available devices used for implementing a respective set of the breakers 11 and the switching devices 15/17 shown in FIG. 4.

FIG. 11 also shows that the illustrated power connector module 58 includes landing lugs 76 which are connected to the mounting member 70 and to the contactor 74. The lugs 76 also connect to the respective set of electrical conductors coming from the respective electrical equipment (e.g., one respective lighting structure at a large area sports facility). These electrical conductors are respective ones of the conductors 8 coming through the conduits 22 illustrated in FIG. 5 for that particular implementation. The lugs 76 implement the connectors 19 shown in FIG. 4.

Still another feature of the power connector module 58 shown in FIG. 11 is an identification member 78 which is connected to the mounting member 70. The identification member 78 has indicia identifying the respective light structure (or other electrical equipment) from which the respective set of electrical conductors connects to the landing lugs. For example, as illustrated in FIG. 8, the indicia include the alphanumeric markings designating "pole A1" which refers to light pole A1 in the overall system such as represented in FIG. 1.

The various components described above as connected to the mounting member 70 are connected thereto by any suitable means. One example is by screws passing through holes in the member 70 and into threaded engagement in holes in the bodies of the respective components.

Referring now to FIG. 12, the control transformer module 63 of the illustrated embodiment includes a mounting member 80 which may be the same as the mounting member 70. A breaker 82, implementing the breaker 13 of FIG. 4, is connected to the member 80, as is a control transformer 84, which implements the transformer 23 of FIG. 4. The breaker 82 is illustrated with two wires connected to adapt it for connecting two phase lines of the bus 56 to the primary of the transformer 84. A reduced voltage (e.g., 120 volts(ac)) is provided from the secondary 6 f the transformer 84. Such voltage is provided at both lines L1 and L2 relative to neutral line N, which lines are connected to connector block 86 which includes fuses 88 (e.g., 120-volt, 20-amp fuses in a particular implementation) implementing the fuses 25 of FIG. 4. At least one of these fused lines connects to the manual ("hand") terminal of a switch 92 (FIGS. 5 and 8) implementing the switch 21 of FIG. 4. Connection of these components onto the mounting member 80 is by any suitable means, such as screws as described above for mounting member 70.

Construction of the individual modules 58, 63 (and the module for the main breaker 50) and back plate 51 and their relationship to the housing 30 are preferably such as to leave ample space near the side of the housing 30 through which the conductors 8 enter, as illustrated in FIG. 8, to facilitate handling the conductors 8 (e.g., for connecting to the lugs 76, or for replacing the conductors 8).

Referring to FIG. 8, the cavity 32 of the housing 30 also includes a region 60 providing means for receiving a remote diagnostic unit for monitoring operation of the plurality of light structures or other electrical equipment electrified using the control unit 6. One example of a remote diagnostic unit is a commercially available device marketed under the brand name "Control Link" by Musco Lighting, Inc. of Oskaloosa, Iowa. If no remote diagnostic unit is to be used, the region 60 can be used for additional power connector or control transformer modules 58, 63 or other suitable equipment if needed. If the control unit 6 implements a remote diagnostic device, the device is disposed in the region 60 (see, e.g., device 71 depicted in FIG. 8) of the cavity 32 of the housing 30 and connected to the power connector modules 58 (or to the control transformer module 63 in the embodiments including such apparatus). The connection to the modules 58 (or module 63) is such that the diagnostic device is able to sense electrical parameters related to. operation of the light structures or other electrical equipment being energized through the control unit 6. For example, current flow through each of the power connector modules can be sensed from within the housing 30, and data about the sensed current flow can be transmitted out of the enclosure.

Figure 14:
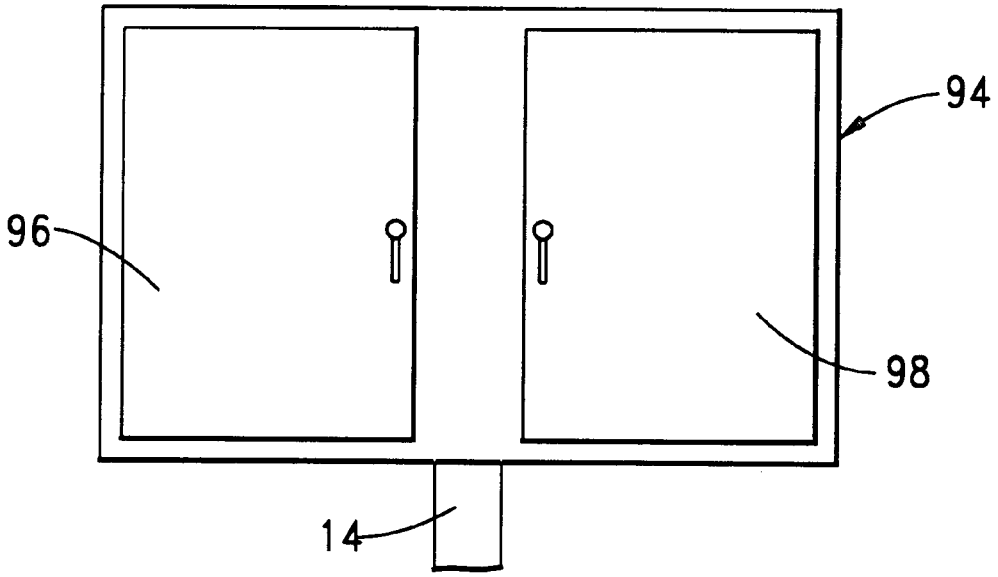
FIG. 14 is a front view of a preferred embodiment of an additional housing attached to the housing of FIG. 5, for example, to provide space for installation of utility equipment, such as electric meters, transformers, connectors, etc.
Figure 15:
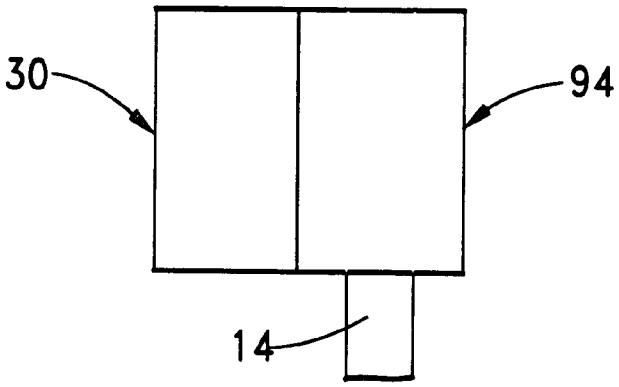
FIG. 15 is side view of the embodiment of FIG. 14.

Referring to FIG. 13, a larger embodiment than that shown in the foregoing drawings of FIGS. 8–10 is illustrated. It is marked with like reference numerals to indicate like components. This illustrates how the simplified modular construction of the present invention facilitates different sizes of equipment to be constructed without losing the standardization, organizational, and other advantages of the invention. Of course, other variations are possible while remaining within the scope of the present invention. Non-limiting examples include other shapes and sizes of the equipment and combinations of multiple components of the invention, such as using two or more housings 30 side-by-side to enable significantly larger numbers of individual circuits to be centrally controlled using the present invention. A back-to-back construction can also be used. Referring to FIGS. 14 and 15, a dual-chamber housing 94 is bolted or otherwise suitably connected to the back wall of the housing 30. The housing 94 has the two chambers accessible through respective lockable doors 96, 98; and the chambers are spaced apart by a central passageway which receives the pole 14 of stanchion 12 as depicted in FIGS. 14 and 15. The housing 94 can be used, for example, for utility (or other power provider) equipment (e.g., electric meters, transformers, cabling, solar cells (which could obviate the necessity for connection to an external power mains), etc.). For example, an electric meter can be mounted inside, or preferably through a side wall of the housing 94 for facilitating meter-reading, and connected into cabling from the power mains and a step-down transformer having a secondary connected to wiring extending to the housing 30 (such as through aligned holes, e.g., including hole 54).

Although the present invention in some aspects encompasses uses other than large area sports facility lighting, a method of the present invention is specifically related to that one environment. This method is for illuminating at least a sports event portion of a large area sports facility. The method comprises activating and deactivating a plurality of light structures which are disposed throughout the sports facility to provide light for at least the sports event portion of the sports facility. The activating and deactivating occur such as using the above-described control unit or apparatus. Specifically, the activating and deactivating are provided from the unitary enclosed lighting control unit described above and located at the sports facility. Such control unit has the plurality of power connector modules removably disposed therein to permit ready repair. This enables electric current to be conducted through a respective one of the power. connector modules to activate a respective one of the light structures. This also includes identifying the respective light structure with indicia (e.g., identification member 78) on the respective power connector module, which simplifies installation and repair. This method can further comprise sensing current flow through each of the power connector modules from within the unitary enclosed lighting control unit and transmitting out of the unitary enclosed lighting control unit data about the sensed current flow. This can be implemented using the remote diagnostic device described above.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A sports lighting system for a large area at which a sporting event occurs, comprising:

a plurality of light structures located at the large area to illuminate at least that portion of the large area where the sporting event occurs a lighting control unit disposed at the large area, the lighting control unit including:

a housing providing a protected cavity;

a main circuit breaker disposed in the cavity of the housing and connected to a three-phase power main;

a three-phase power bus disposed in the cavity of the housing and connected to the main circuit breaker;

a plurality of power connector modules connected to the three-phase power bus in the cavity of the housing; and a master on/off control connected to the power connector modules; and respective sets of electrical conductors for each of the plurality of light structures, wherein each respective set connects to a respective one of the power connector modules of the lighting control unit and to lighting on the respective light structure such that electrification of lighting on all the light structures occurs through the lighting control unit;

wherein each power connector module includes:

a mounting member that mounts the respective power connector module as a unit in the housing such that the entire respective power connector module is removable and replaceable as a unit;

a breaker unit connected to the mounting member and to the three-phase power bus;

a contactor unit connected to the mounting member and to the breaker unit and to the master on/off control, wherein the contactor unit includes a relay coil;

two wires connected to the relay coil and disposed on the mounting member to provide electrical connection from the master on/off control to the relay coil; and landing lugs connected to the mounting member and to the contactor unit and the respective set of electrical conductors.

2. A sports lighting system as defined in claim 1, wherein:

the system further comprises a ground-mounted concrete stanchion at the large area; and the lighting control unit further includes a plurality of brackets connected to the housing and mounted on the concrete stanchion.

3. In a large area at an arena or stadium at which a sporting event occurs under illumination from a plurality of multiple fixture light structures, the improvement comprising:

a ground-mounted concrete stanchion installed at the large area; and a lighting control unit connected to the concrete stanchion, the lighting control unit including a master on/off switch and a housing providing a protected cavity in which all main electrical power control connections with the master on/off switch mounted therein are made to the plurality of light structures located at the large area to illuminate at least that portion of the large area where the sporting event occurs such that concurrent electrically parallel on/off control of the light structures occurs through operation of the master on/off switch, wherein the lighting control unit further includes:

a main circuit breaker disposed in the cavity of the housing to connect to a power main;

a power bus disposed in the cavity of the housing and connected to the main circuit breaker; and a plurality of power connector modules connected to the power bus in the cavity of the housing and operatively responsive to the master on/off switch, wherein each power connector module includes:

a mounting member;

a breaker unit connected to the mounting member and to the power bus;

a contactor unit connected to the mounting member and to the breaker unit, wherein the contactor unit includes a relay coil;

two wires connected to the relay coil and disposed on the mounting member to provide electrical connection from a control circuit including the master on/off switch to the relay coil; and landing lugs connected to the mounting member and to the contactor unit.

4. Apparatus as defined in claim 3, further comprising a second housing connected to the first-mentioned housing, the second housing attached to the stanchion to receive electric utility equipment.

5. An electrical control unit, comprising:

a housing providing a protected cavity;

a main circuit breaker disposed in the cavity of the housing to connect to a three-phase power main;

a three-phase power bus disposed in the cavity of the housing and connected to the main circuit breaker; and a plurality of power connector modules connected to the three-phase power bus in the cavity of the housing, wherein each power connector module further includes:

a mounting member;

a breaker unit connected to the mounting member and to the three-phase power bus;

a contactor unit connected to the mounting member and to the breaker unit, wherein the contactor unit includes a relay coil;

conductors connected to the relay coil and disposed on the mounting member to provide electrical connection from a controller to the relay coil; and landing lugs connected to the mounting member and to the contactor unit.

6. An electrical control unit as defined in claim 5, further comprising a plurality of brackets connected to the housing to mount on a ground-mounted concrete stanchion.

7. A power connector module, comprising:

a mounting member to removably mount in a housing to connect to a three-phase power bus in the housing;

a breaker unit connected to the mounting member such that the breaker unit is disposed for electrical connection to the three-phase power bus when the mounting member is mounted in the housing;

a contactor unit connected to the mounting member and to the breaker unit, wherein the contactor unit includes a relay coil;

two wires connected to the relay coil and disposed on the mounting member to provide electrical connection from a controller to the relay coil; and landing lugs connected to the mounting member and to the contactor unit for connecting to a respective set of electrical conductors connected to electrical equipment to be electrified through the power connector module.

8. A power connector module as defined in claim 7, wherein the mounting member has an edge configured for inserting into a trough defined in the housing.

9. A power connector module, comprising:

a mounting member to removably mount in a housing to connect to a power bus in the housing;

a breaker unit connected to the mounting member such that the breaker unit is disposed for electrical connection to the power bus when the mounting member is mounted in the housing;

a contactor unit connected to the mounting member and to the breaker unit, wherein the contactor unit includes a relay coil;

two wires connected to the relay coil and disposed on the mounting member to provide electrical connection from a controller to the relay coil; and landing lugs connected to the mounting member and to the contactor unit for connecting to a respective set of electrical conductors connected to electrical equipment to be electrified through the power connector module.

10. A power connector module as defined in claim 9, wherein the mounting member has an edge configured for inserting into a trough defined in the housing.

11. A method for illuminating at least a sports event portion of a large area sports facility, comprising activating and deactivating in common a plurality of light structures, which structures are disposed throughout the sports facility to provide light for at least the sports event portion of the sports facility, from a unitary enclosed lighting control unit located at the sports facility and having a plurality of power connector modules respectively removably disposed therein, including conducting electric current through a respective one of the power connector modules to activate a respective one of the light structures such that each light structure is turned on and off through a respective commonly controlled power connector module to which respective electric conductors from the respective light structure directly connect, wherein each power connector module respectively includes:

a mounting member removably mounted in a housing of the unitary enclosed lighting control unit;

a breaker unit connected to the mounting member such that the breaker unit is electrically connected to a power bus in the housing;

a contactor unit connected to the mounting member and to the breaker unit, wherein the contactor unit includes a relay coil;

control conductors connected to the relay coil to provide electrical connection from a controller to the relay coil; and landing lugs connected to the mounting member and to the contactor unit connected to the respective electrical conductors connected to the respective light structure; and wherein conducting electric current through a respective one of the power connector modules to activate a respective one of the light structures includes actuating the relay of the respective power connector module through the control conductors by operation of the controller.

12. A sports lighting system, comprising:

a large area sports facility selected from the group consisting of a basketball arena, a hockey arena, a football stadium, a baseball stadium, a soccer stadium, and a racetrack;

a plurality of light structures located at the large area sports facility to illuminate at least that portion of the large area where the sporting event occurs, each of the light structures including a respective plurality of light fixtures;

a lighting control unit providing a common lighting control location at the large area sports facility;

a plurality of sets of electrical conductors, each set connected to light fixtures of a respective one of the light structures and extending therefrom to the common lighting control location at the large area sports facility; and a power source cable communicating electricity from a three phase power main to the common lighting control location;

wherein the lighting control unit includes:

a three-phase power bus;

a main circuit breaker connected to the three-phase power bus;

a plurality of breaker-contactor-connector circuits connected to the three-phase power bus, wherein each contactor thereof, includes a relay;

a master on/off control connected to the three-phase power bus and to the relay of the contractor of each breaker-contactor-connector circuit such that the breaker-contactor-connector circuits are commonly controlled by the master on/off control;

a housing providing a protected cavity in which the three-phase power bus, the main circuit breaker, the plurality of breaker-contractor-connector circuits, and the master on/off control are disposed, the housing providing access into the cavity and receiving therethrough part of the power source cable such that the power source cable connects to the main circuit breaker and also receiving therethrough parts of the plurality of sets of electrical conductors such that each set connects to a respective one of the breaker-contactor-connector circuits, whereby the light fixtures of the light structures are turned on or off together under control of the master on/off control in the housing at the common lighting control location at the large area sports facility.

13. A sports lighting system as defined in claim 12, further comprising a concrete stanchion having a concrete mounting base disposed in a hole defined at the common lighting control location and back filled with concrete to a depth below the mouth of the hole, and wherein the housing is mounted on the concrete stanchion.

14. A sports lighting system as defined in claim 13, wherein the housing includes lifting eyes by which the housing is lifted onto and off of the concrete stanchion.

15. A sports lighting system as defined in claim 14, wherein the housing includes a trough in which the plurality of breaker-contactor-connector circuits are removably disposed.

16. A sports lighting system as defined in claim 12, wherein:

the three-phase power bus includes three spaced parallel copper bus bars mounted in the housing;

each of the breaker-contactor-connector circuits defines a respective power connector module removably mounted in the housing such that the respective breaker thereof is closer to the bus bars than are the respective contactor and connector thereof, the respective breaker electrically connected to the three copper bus bars, the connector of such respective power connector module disposed in the power connector module opposite the respective breaker thereof and connected to the respective set of the electrical conductors.

17. A sports lighting system as defined in claim 16, wherein the power connector modules are removably disposed adjacent and parallel to each other in a trough defined in the housing.

18. A sports lighting system as defined in claim 12, wherein the housing includes a trough in which the plurality of breaker-contactor-connector circuits are removably disposed.

* * * * *

UNITED STATES PATENT AND TRADEMARK OFFICE

CERTIFICATE OF CORRECTION

PATENT NO. : 6,501,233 B1 
DATED : December 31, 2002
INVENTOR(S) : William R. Odell and Ronald N. Odell It is certified that error appears in the above-identified patent and that said Letters Patent is hereby corrected as shown below:

Column 4,
Line 19, delete "F our" and insert -- Four -- therefor.
Line 42, delete "a nd" and insert -- and -- therefor.

Column 8,
Line 1, delete "6 f" and insert -- of -- therefor.

Column 9,
Line 48, after "occurs," insert -- ; --.

Column 12,
Line 62, after "thereof" and before "includes" delete the comma.

Signed and Sealed this

Eighteenth Day of March, 2003

JAMES E. ROGAN
*Director of the United States Patent and Trademark Office*